US006880475B1

(12) United States Patent
Thompson

(10) Patent No.: US 6,880,475 B1
(45) Date of Patent: Apr. 19, 2005

(54) PERSONAL WATERCRAFT ERGONOMIC FOOTWELLS

(75) Inventor: John E. Thompson, Spirit Lake, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/618,960

(22) Filed: Jul. 14, 2003

(51) Int. Cl.[7] ..... B63B 35/73
(52) U.S. Cl. ..... 114/55.55; 114/363
(58) Field of Search ..... 114/55.55, 363

(56) References Cited

U.S. PATENT DOCUMENTS 5,447,116 A 9/1995 Kobayashi ..... 114/363
6,035,802 A 3/2000 Lussier ..... 114/363
6,116,182 A 9/2000 Koyanagi ..... 114/362
6,457,433 B1 * 10/2002 Nagata ..... 114/343

OTHER PUBLICATIONS

PWC Ergonomics as understood by applicants, 1 page.

* cited by examiner

*Primary Examiner*—Ed Swinehart
(74) *Attorney, Agent, or Firm*—Fredrikson & Byron, P.A.

(57) ABSTRACT

Personal watercraft having ergonomically improved footwell designs. The footwells reside on either side of the personal watercraft straddle-type seat and can include higher outside footwell walls in preferred embodiments. The higher outside footwell walls can provide added protection to the driver's legs from unwanted contact from other boats and docks. Several improved footwells are provided, and include improved height to bottom width ratios and improved inner and outer wall angles. Footwells according to the present invention provide for more comfortable driver placement within the personal watercraft as well as easier egress from the watercraft and easier extraction of the driver's feet.

8 Claims, 6 Drawing Sheets

PERSONAL WATERCRAFT ERGONOMIC FOOTWELLS

FIELD OF THE INVENTION

The present invention is related generally to personal watercraft. More specifically, the present invention is related to personal watercraft footwells.

BACKGROUND OF THE INVENTION

Personal watercraft, sometimes referred to as "jet skis", initially evolved from jet boats. Personal watercraft have typically had a straddle-type seat situated on the top deck of the watercraft, with a place for the driver's feet on either side of the seat, often referred to as the footwells.

Personal watercraft have conventionally had horizontally straight bond lines, similar to most boats. Footwell design has often been given little thought. This has resulted in some footwells that are not the most comfortable for the driver. It may awkward for the driver to initially position his or her feet within the footwell. In addition, it may not be easy for the driver to extract their feet from such footwells. In particular, it may not be easy to rapidly extract a foot from the footwell in a docking or collision situation.

What would be desirable are personal watercraft footwells ergonomically designed from the beginning. Ergonomic footwells designed to allow easy and rapid removal of the driver's feet would be advantageous.

SUMMARY OF THE INVENTION

The present invention provides a personal watercraft comprising a hull including a bottom hull and a top deck secured over the bottom hull, the hull defining an engine compartment sized to contain an internal combustion engine for powering a jet propulsion unit. The jet propulsion unit can include a steerable water discharge nozzle. The personal watercraft preferably has a top deck having a raised, longitudinally extending seat adapted to accommodate an operator in straddle fashion. The top deck has a footwell disposed on either side of the seat.

In one embodiment of the invention, the footwell has a bottom width and an outside wall vertical height, where the ratio of the footwell outside wall vertical height to the footwell bottom width is greater than 1.8. In other embodiments, the ratio is greater than about 1.85, and about 1.9.

In another embodiment of the invention, the ratio of the footwell outside wall vertical height to the footwell bottom width is greater than 1.6, and the footwell outside vertical height is greater than 11 inches or the footwell bottom width is greater than 6 inches.

In still another embodiment, the watercraft has a ratio of the footwell outside wall vertical height to the footwell bottom width greater than 1.4 and the footwell inside wall angle inward from vertical is greater than 8 degrees. In still another personal watercraft, the footwell outside wall vertical height is greater than 9 inches and the footwell inside wall angle inward from vertical is greater than 8 degrees. In yet other embodiments, the footwell outside wall vertical height is greater than 9 inches or 10 inches and the footwell inside wall angle inward from vertical is greater than 9 degrees. In variations of these embodiments, the footwell outside wall vertical height is greater than 10 inches in one embodiment, and greater than 12 inches in another embodiment.

In one example of the present invention, the personal watercraft has the footwell outside vertical height being greater than 12 inches and the footwell outside wall angle outward from vertical being less than 10 degrees. In a variation of this embodiment, the footwell outside wall angle outward from vertical is less than 9 degrees.

In another aspect of the invention, the watercraft upper deck uppermost portion located on the outside of the footwell has a rounded shape, with a radius of curvature of at least about 1 inch. In a preferred embodiment, the radius of curvature is about 1.5 inch.

The present invention provides layouts of footwells on personal watercraft that provide sufficient room when boarding or exiting the watercraft. The driver's foot can be easily and rapidly extracted from the footwell, even in the situation the driver is thrown from the watercraft or the watercraft tips to the side. The footwells of the present personal watercraft, in some embodiments, include a high outer wall providing superior protection for the driver's legs, while providing ease of egress, rather than a deep, narrow footwell that might otherwise result from only increasing the depth of the footwell. Some footwells, as described further in the detailed description, also have more inwardly angled inner walls to allow the driver to better hug the inner walls, particularly in tight cornering situations.

DETAILED DESCRIPTION OF THE PREFERRED EMBODIMENTS

Figure 1:
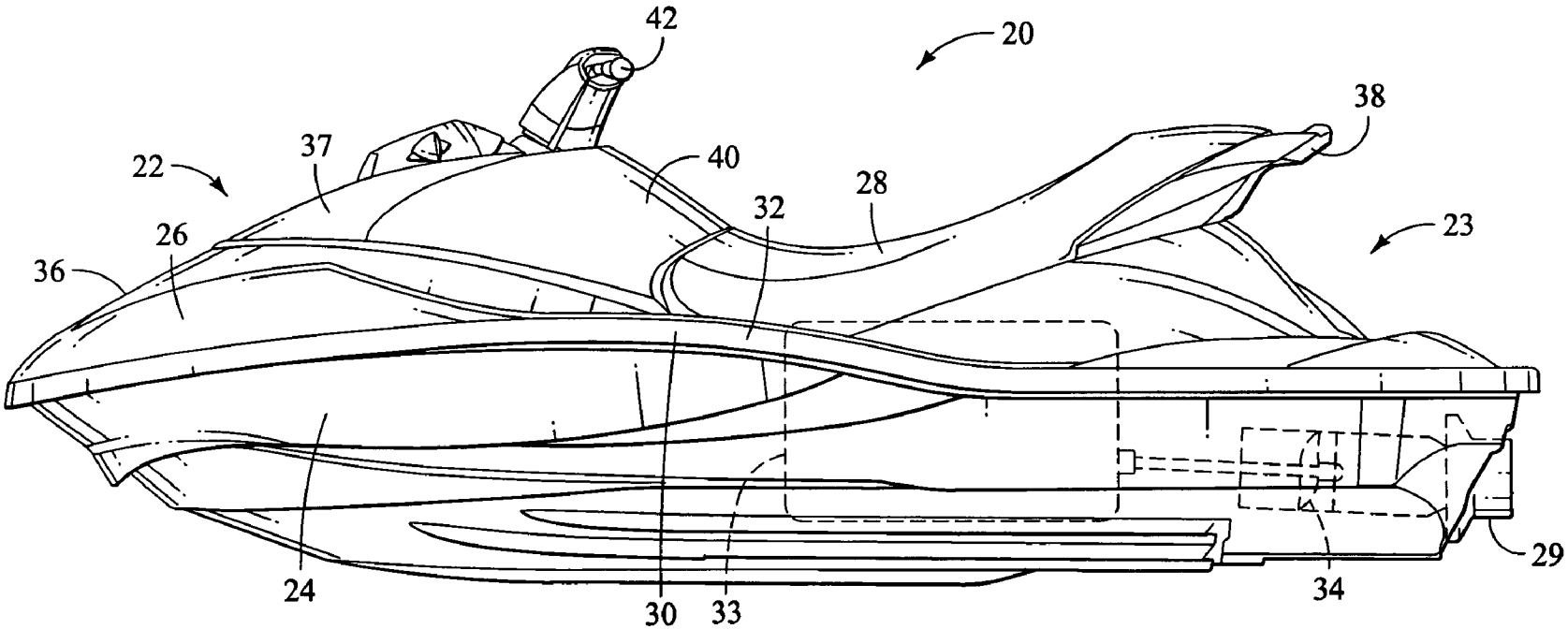
FIG. 1 is a side, cutaway view of a personal watercraft having a raised and protective bond line, creating a protective footwell in the region of the driver's knee.

The following detailed description should be read with reference to the drawings, in which like elements in different drawings are numbered identically. The drawings depict selected embodiments and are not intended to limit the scope of the invention. Several forms of invention will be shown and described, and other forms will now be apparent to those skilled in art. It will be understood that the embodiments shown in the drawings and described below are merely for illustrative purposes, and are not intended to limit the scope of the invention as defined in the claims that follow.

FIG. 1 illustrates a personal watercraft 20 having generally a front or bow 22 and a rear or stern 23. Personal watercraft 20 includes a top deck 26 secured to a bottom hull 24 along an overlapping portion covered with a rub rail 32 in the embodiment illustrated, forming a hull. A hood 37 may also be seen, joined to top deck 26 at a hinged front hood portion 36. The hull formed by the bottom hull 24 and top deck 26 define a compartment sized to contain an internal combustion engine 33 for powering the watercraft, and may also include one or more storage compartments, depending upon the size and configuration of the watercraft. The deck portion 26 also has a raised, longitudinally extending seat 28 adapted to accommodate one or more riders seated in straddle fashion on the seat 28. A grab handle 38 is disposed transversely across the rear of the seat. Engine 33 powers a jet propulsion unit 34, typically mounted in a tunnel at the bottom rear portion of the watercraft, all shown in phantom in FIG. 1. Jet propulsion unit 34 includes a steerable water discharge nozzle 29 that is operatively connected to a set of handlebars 42 to facilitate steering of the watercraft by the operator. Handlebars 42 typically mount through a top portion of a shroud 40. The connection between handlebars 42 and discharge nozzle 29 may be of any suitable type, and typically includes mechanical linkages including a control cable. If desired, an electronic connection could also be utilized.

Personal watercraft 20 may be seen to have a distinctive vertically curved bond line, protected here by rub rail 32. The bond line has a general location, indicated at 30, where a driver's knee may be located during use. The bond line, in this embodiment, is the general location where the top deck meets the bottom hull, with the top deck being bonded to the bottom hull along a vertical flange in this example of the invention. The top deck can curve over the bottom deck along the bond line, as in this example. This uniquely shaped watercraft bond line serves at least two purposes.

The upwardly vertically curved bond line gives the watercraft an aesthetically pleasing shape. This shape is an alternative to the straight, horizontal bond line, commonly seen on conventional personal watercraft. The raised bond line also serves to better protect the driver's legs from unwanted contact with other watercraft. The raised bond line further serves to better protect the driver's legs from unwanted contact with docks while docking the watercraft. The raised bond line also serves to keep water out of the footwell.

Figure 2:
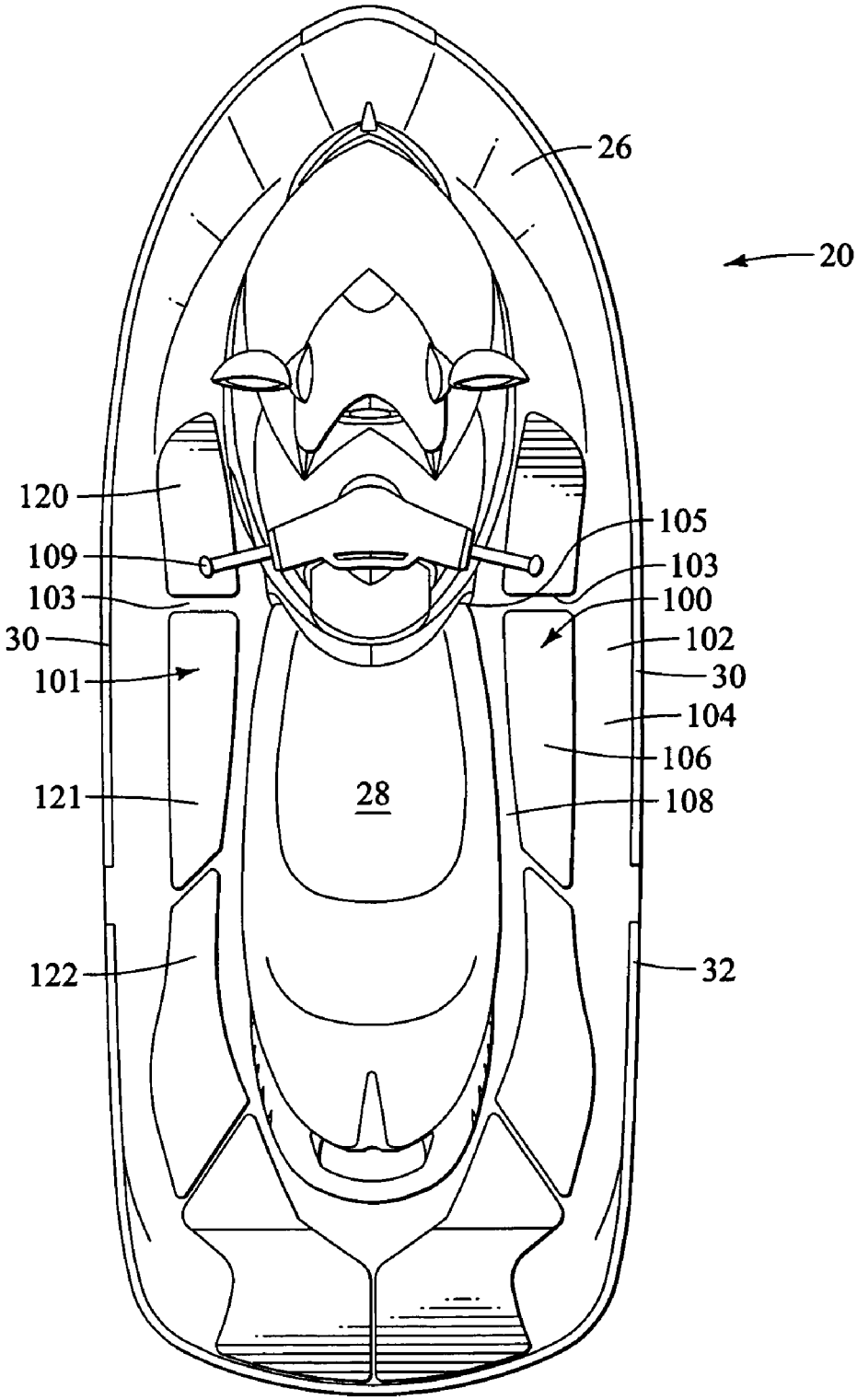
FIG. 2 is a top view of the personal watercraft of FIG. 1, showing the footwells on either side of the straddle-type seat.

FIG. 2 illustrates personal watercraft 20 from a top view. Straddle-type seat 28 is disposed between a right footwell 100 and a left footwell 101. The outside of the top deck is protected by rub rail 32. Location 30 may be seen, as previously illustrated in FIG. 1. Top deck 26 may be seen to include a top or uppermost portion 102, sloping downward and inward along a footwell outer wall 104, coming to reside in a footwell flat region 106. Continuing further inward, top deck 26 extends upward and inward along a footwell inner wall portion 108.

In left footwell 101, the footwell pad areas 120, 121, and 122 may be seen. In the watercraft embodiment illustrated in FIG. 2, the footwell pads include a rear pad region 122, a middle footwell pad region 121, and a front footwell pad region 120. In this embodiment, rear footpad 122 covers a forwardly downwardly sloping region, while middle footpad 121 covers a flat, horizontal region. Front footpad 120 covers a forwardly upwardly sloping region. A bend 103 may be seen, where the horizontal region changes to the forwardly and upwardly extending region. Bend 103 may be seen as lying near the front-most seat extent 105 and the rear-most handlebar extent 109.

As may be seen from FIG. 2, the slopes of outer wall region 104 and inner wall region 108, together with the width of footwell region or floor region 106, can significantly affect the ergonomics of the personal watercraft for the rider. As will be discussed further, the height of outer wall 104 can also have an impact on the rider ergonomics.

Figure 3:
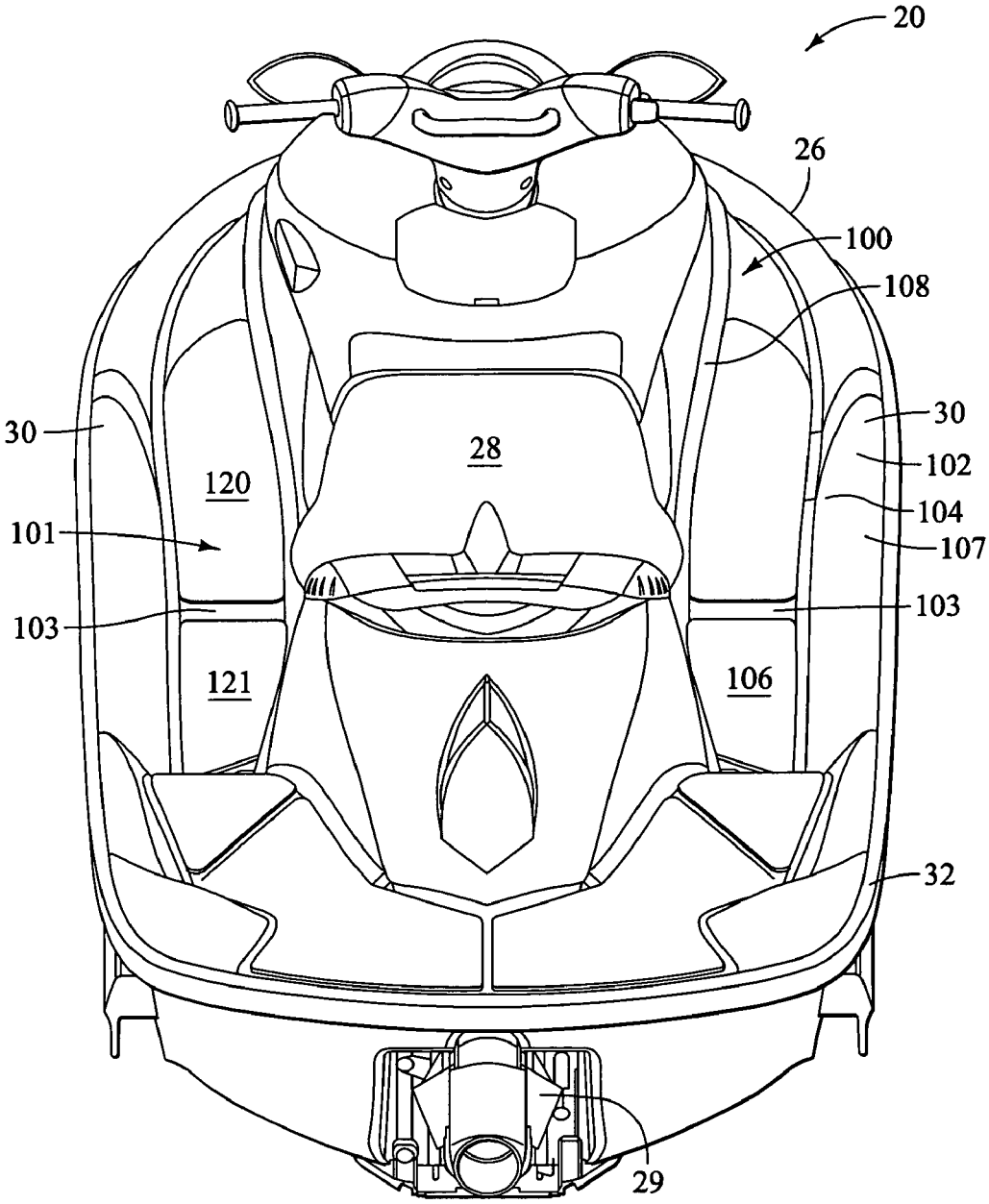
FIG. 3 is rear, upper, perspective view of the personal watercraft of FIGS. 1 and 2, showing the horizontal footwell surface, the inward and upward slope of the inner wall, the outward and upward slope of the outer wall, and the curved uppermost portion of the top deck.

FIG. 3 illustrates personal watercraft 20, from a top, rear view. Right footwell 100 may be seen as well as left footwell 101. Right footwell 100 includes flat, bottom or floor region 106, lying under footpad 121, that extends upward and outward along outer wall 104, to reach a vertically uppermost region 102. An outwardly and downwardly extending region 107 may be seen to the outside of uppermost region 102. Top deck 26 continues outward and downward in a rounded, U-shaped configuration. Rub rail 32, discharge nozzle 29, inner wall 108, location 30, seat 28, bend 103, and foot pads 120 and 121 may be seen, as previously described.

Figure 4:
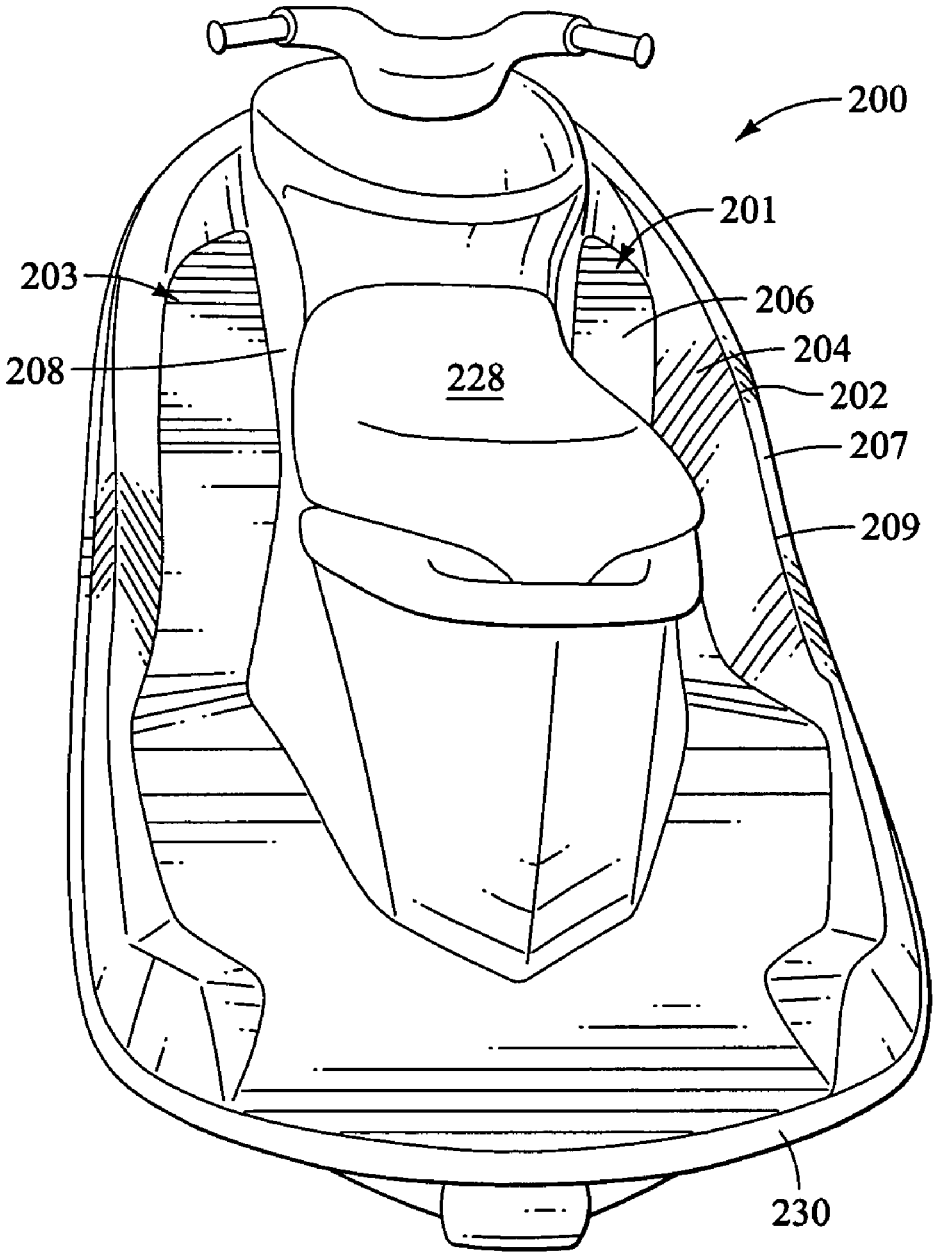
FIG. 4 is a rear, upper, side perspective view of another personal watercraft having ergonomically improved footwells according to the present invention.

FIG. 4 illustrates another personal watercraft 200, similar in many respects to personal watercraft 20 of FIGS. 1–3. Personal watercraft 200 includes a straddle-type seat 228 having a right footwell 201 and a left footwell 203. Footwell 201 may be seen to include a bottom or floor region 206, and outwardly and upwardly-extending outer wall region 204, and an uppermost region 202. An outwardly and downwardly extending region 207 may also be seen, extending outwardly from uppermost region 202. In a preferred embodiment, uppermost region 202 is gently curved or rounded. Line 209, shown on FIG. 4, is used to indicate the location of an uppermost region of the top deck, rather than indicating a sharp bend in the uppermost region of the top deck outside of the footwells. Left footwell 203 may be seen to include an inwardly and upwardly-extending footwell inner wall region 208. A rub rail 230 may be seen wrapped around personal watercraft 200.

Figure 5:
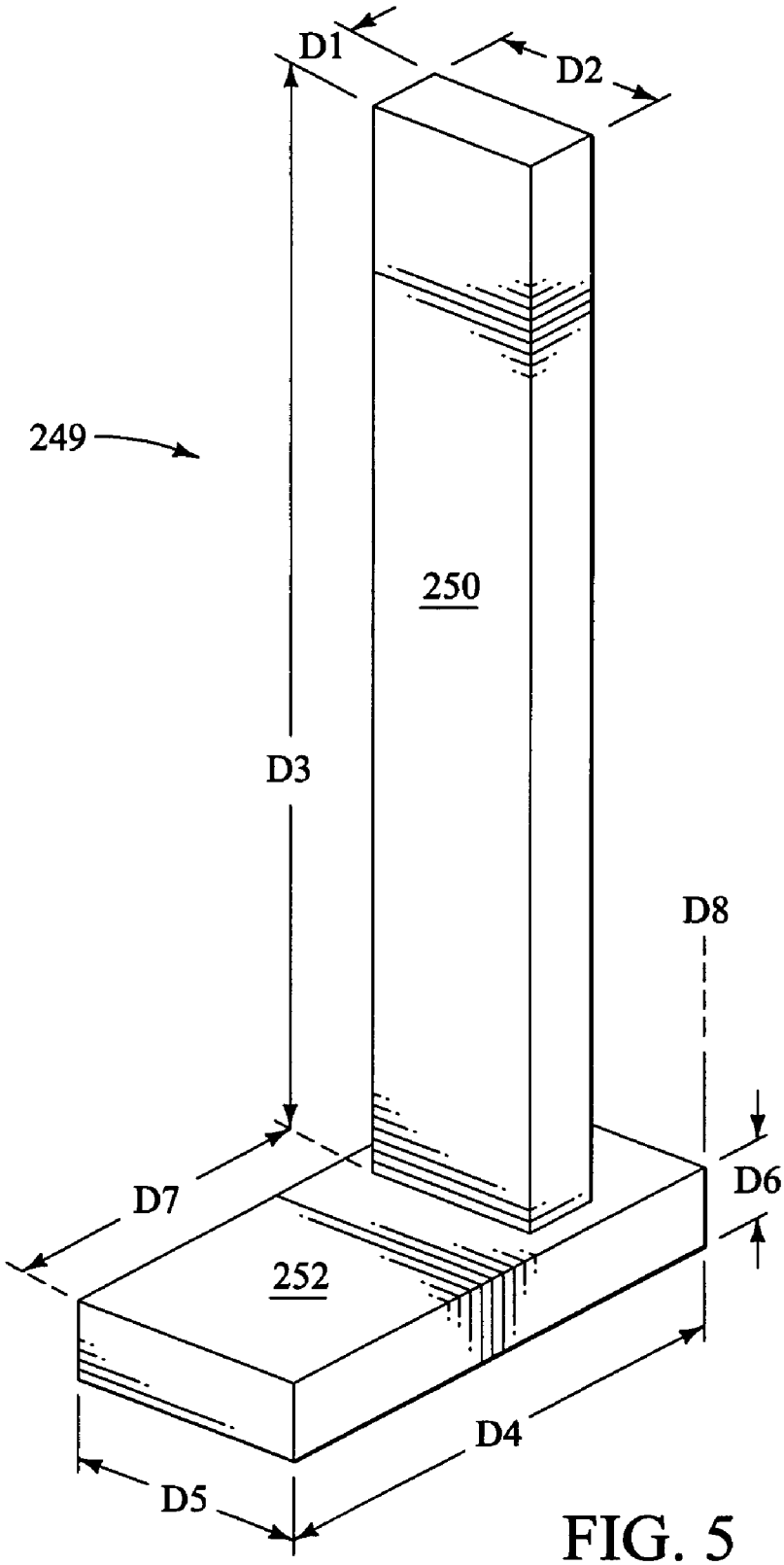
FIG. 5 is a perspective view of a wooden leg used to test older, conventional watercraft footwells, and to design the improved footwells of the present invention.

FIG. 5 illustrates a wooden leg 249 that was used in extensive ergonomic modeling and studies of the present invention and other, older, conventional design watercraft. Wooden leg 249 includes generally, "lower leg" 250 and a wooden "foot" 252. Wooden lower leg 250 was formed from a 2×4, having a depth of 1.5 inches, indicated at D1, a width of 3.5 inches, indicated at D2, and a height of 21 inches, indicated at D3. The wooden foot 252 has a width of 4.75 inches indicated at D5, and a length of 10.5 inches, indicated at D4. Foot 252 also includes a height of 1.5 inches, indicated at D6. Lower leg 250 is secured to foot 252 such that 6.25 inches lies in front of lower leg 250, indicated at D7, and 2.5 inches lies behind lower leg 250 on foot 252, indicated at D8. Wooden leg 249 was sized to approximate the foot and the lower leg of a driver of 175 pounds and 5'9" in height.

Applicants believed that conventional watercraft suffered from conventional design, having less than optimal ergonomics in the footwell region. With the improved protection offered by the higher footwell outer wall of the present invention, such less than optimal ergonomics would be exacerbated, without the improvements provided by the present invention. In particular, a higher, outer footwell wall, if raised relative to the outer wall height of conventional watercraft, could create a deeper footwell having the same lower width. This could present a problem in the ease of egress from the personal watercraft. In difficult situations where drivers had difficulty in removing their leg from the footwell, their foot could even become momentarily stuck as they attempted to exit the watercraft. Some conventional designs, having the added height, would also end up being relatively deep and narrow and having an inward wall that was difficult to grasp with the inside of the driver's legs when cornering.

Figure 6:
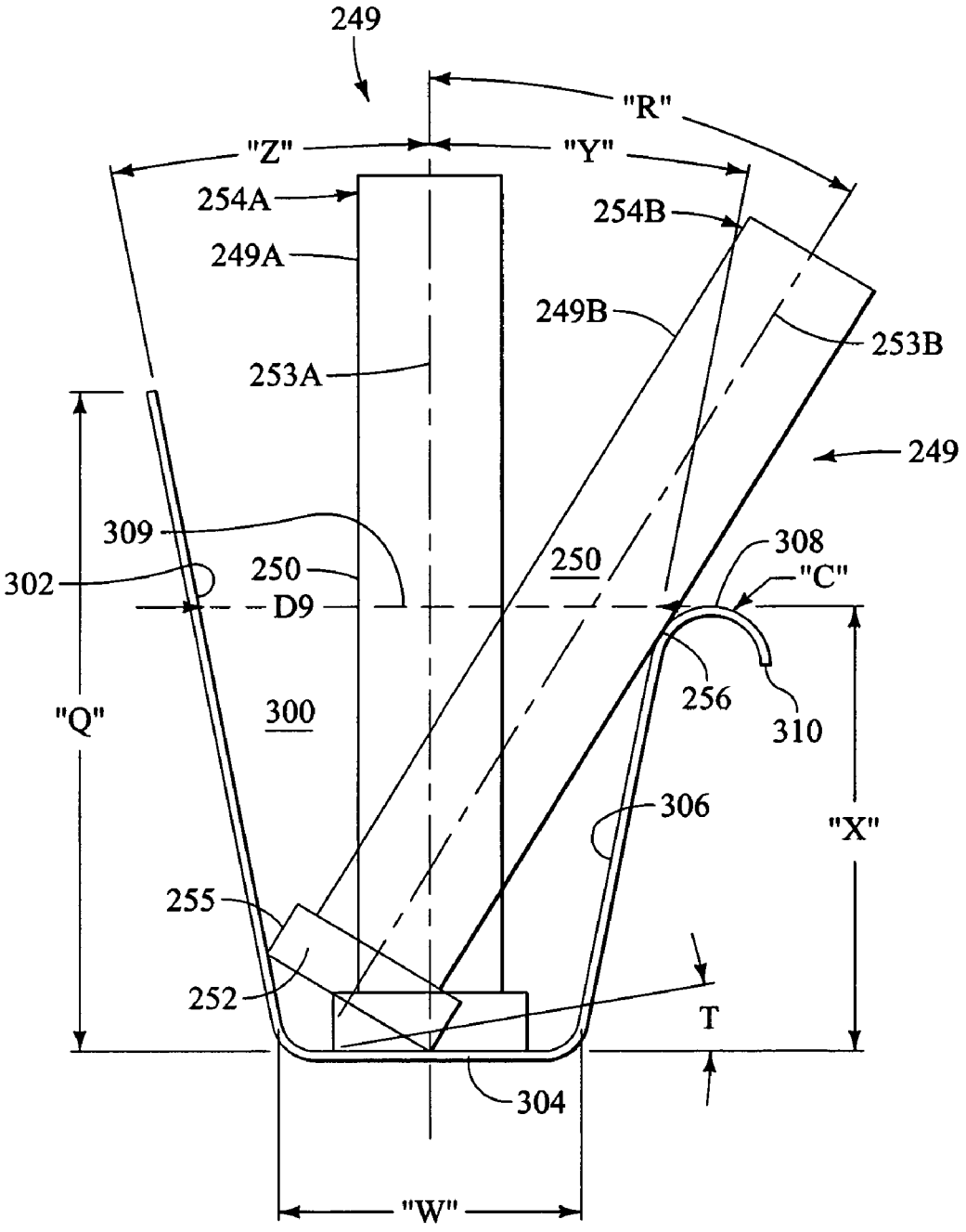
FIG. 6 is a transverse, cross-sectional view of a footwell having wooden leg 249 of FIG. 5 disposed within, in both a vertically upward position and "slipped", outwardly angled position.

FIG. 6 illustrates wooden leg 249, shown at a first position 249A, and a second position 249B within a footwell 300.

Footwell 300 includes an inward and upwardly sloping wall 302, a bottom or floor region 304, and outwardly and upwardly extending out wall region 306, an upward most region 308, and a downwardly oriented outer lip 310. Wooden leg 249 includes a center line drawn through the middle of lower leg 250. A first center line 253A may be seen in position 249A, and a second center line 253B may be seen in second position 249B. In first position 249A, wooden leg 249 is centered within footwell 300 and is vertically oriented within the footwell. In position 249B, wooden leg 249 is shown in a position resulting from applying a force perpendicular to center line 253A in an outward direction, indicated at 254A. As the normal force is continued, wooden leg 249 eventually tips and foot 252 slides inward. At this point, the inner surface 255 of foot 252 may be seen resting against footwell inner wall 302. Lower leg 250 may be seen resting against footwell outer wall 306 at 256. In some watercraft footwell designs, further normal force applied to lower leg 250, indicated at 254B, will result in strain being put on leg 249. In the present invention, however, further force applied perpendicularly to lower leg 250, indicated at 254B, allows wooden foot 252 to slide upward along inwardly and upwardly sloped footwell inner wall 302, allowing foot 249 to be freed from footwell 300. Inspection of FIG. 6 shows how a higher outer wall 306 could result in foot 249 being somewhat trapped within footwell 300, when twisted or tilted at an angle, as indicated at position 249B.

In conventional models, where top deck upper most portion 308 terminates vertically upward in a sharp bend, the localized force brought to bear on lower leg 250 by such a sharp upward vertex may be seen by inspecting FIG. 6. In contrast, in the embodiment of the invention illustrated in FIG. 6, upward upper deck portion 308 has a gentle curve, having a radius of curvature indicated by "C." A preferred embodiment, C has a radius of curvature of at least about 1 inch, and preferably about 1.5 inch.

Inner footwell wall 302 has an angle inward of vertical of Z degrees, indicated at Z in FIG. 6. Likewise, footwell 300 outer wall 306 has an outer wall angle outward of vertical of Y degrees, indicated at Y in FIG. 6. The angle of leg 249, measured from vertical to the center line 253B, after having been tipped outward, has an angle outward from vertical of R degrees, indicated at R in FIG. 6. Footwell inner wall 302 has a vertical height, indicated at Q, which is preferably about 17–18 inches, which can have about a 4 inch seat disposed on top of the top-most portion of the inner wall. Footwell floor region 304 has a width of about 6.5 inches in one embodiment, indicated by W in FIG. 6. Footwell outer wall 306 has a height, preferably about 12.5 inches, indicated at X in FIG. 6. The top deck preferably has an upwardly convex, smooth, rounded radius of curvature of about 1.5 inches, indicated at C in FIG. 6. Bottom floor region 304 also has an angle from horizontal, preferably of about 0 degrees from horizontal, indicated by T degrees in FIG. 6.

In one embodiment of the invention, the ratio of footwell outside wall vertical height X to the footwell bottom width W is greater than 1.8. Having ratio of at least 1.8 has proven to be ergonomically beneficial to human riders testing mock ups of this newly designed watercraft. By keeping the ratio of the height to the width above this number, the driver's ability to hug the inside walls of the footwell while keeping the driver's feet in a relatively controlled area, appears to be beneficial. In another embodiment, the ratio of the footwell outside wall vertical height to the footwell bottom width is greater than about 1.85. In still another embodiment, the ratio of the footwell outside wall vertical height to the footwell bottom width is greater than about 1.9.

In another personal watercraft, the ratio of the footwell outside wall vertical height to the footwell bottom width is greater than 1.6, and the vertical height is greater than 11 inches. In still another embodiment, the ratio of the footwell outside wall vertical height to the footwell bottom width is greater than 1.6, but the footwell bottom width is greater than 6 inches.

In still another embodiment, the ratio of the footwell outside wall vertical height to the footwell bottom width is greater than 1.4, but the footwell inside wall angle inward from vertical is greater than 8 degrees. Applicants have discovered that by making the footwell bottom width larger relative to the vertical height of some of the other embodiments, the ergonomics for the rider are improved, as is the ease of extracting the driver's foot, thanks to the inwardly sloping inner wall. The ability of wooden leg 249 in FIG. 6 to slide upwardly along inner wall 302 in FIG. 6 may be seen to be benefited by either a lower vertical height to the footwell or by an increasing inner wall angle from vertical of the footwell inner wall. Either situation will ease in extraction of the foot and leg of the driver from the footwell.

In still another embodiment, the footwell outside wall vertical height is greater than 9 inches, and the footwell inside wall angle inward from vertical is greater than 8 degrees. In yet another embodiment, a footwell outside wall vertical height is greater than 9 inches and the footwell inside wall angle inward from vertical is greater than 9 degrees. In variations of this embodiment, the footwell outside wall vertical height is greater than 10 inches in one variation, and greater than 12 inches in another variation.

In another example of the invention, the footwell outside wall vertical height is greater than 12 inches, and the footwell outside wall angle outward from vertical is less than 10 degrees. In a variation on this embodiment, the footwell outside wall angle outward from vertical is less than 9 degrees.

Another aspect of the invention includes the top width of the footwell, indicated by line 309 in FIG. 6, and having a distance indicated at D9 in FIG. 6. The top width of the footwell may be defined as the horizontal distance, measured at the top of the footwell outer wall, from the outer wall (or a continued projection of the outer wall), to the inner wall. The top width is sometimes referred to as the exit width.

The top width in the present invention can vary along the length of the footwell. In various embodiments of the present invention, the footwell top width is greatest near the bend in the footwell floor, greatest near the front-most seat extent, or greatest near the rear-most handlebar extent. In a preferred embodiment, the footwell top width is greater than 12½ inches at some portion along its length. In another embodiment, the footwell has a section along its length having a front disposed near the footwell floor bend and a rear disposed 2 or 2½ feet to the rear of the front. The top width increases forwardly over the section length, and the top width near the section front is greater than 10½, 12, or 13 inches, depending on the embodiment. The top width preferably increases continuously forwardly over the section length. In still another embodiment, the footwell has a top width near the footwell floor bend of greater than 11½, 12, or 13 inches, depending on the embodiment.

What is claimed is:

1. A personal watercraft comprising:

a hull including a bottom hull and a top deck secured over the bottom hull, the bull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, wherein the top deck has a footwell disposed on either side of the seat, wherein the footwell is formed between an inner wall and an outer wall, wherein the footwell has a length, and a top width between the inner wall and the outer wall, wherein the footwell includes a bottom surface, the bottom surface having a substantially horizontal portion beside the seat extending forward to a bend, and an upwardly angled portion extending forward of the bend;

wherein the footwell has a section along its length having a front disposed near the bend and a rear disposed at least 2 feet to the rear of the bend, wherein the footwell section has a top width that increases forwardly over the length of the section, wherein the top width near the section front is greater than 10½ inches.

2. A personal watercraft as in claim 1, wherein the footwell top width near the bend is greater than 12 inches.

3. A personal watercraft as in claim 1, wherein the footwell section has a top width that increases continuously over the length of the section, wherein the footwell top width near the bend is greater than 12 inches.

4. A personal watercraft as in claim 1, wherein the footwell top width near the bend is not less than 13 inches.

5. A personal watercraft as in claim 1, wherein the footwell section has a top width that increases continuously over the length of the section, wherein the footwell top width near the bend is greater than 13 inches.

6. A personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, wherein the top deck has a footwell disposed on either side of the seat, wherein the footwell is formed between an inner wall aid an outer wall, wherein the footwell has a length, and a top width between the inner wall and the outer wall, wherein the footwell includes a bottom surface, the bottom surface having a substantially horizontal portion beside the seat extending forward to a bend, and an upwardly angled portion extending forward of the bend, wherein the footwell top width near bend is greater than 11½ inches.

7. A personal watercraft as in claim 6, wherein the footwell top width near the bend is greater th 12 inches.

8. A personal watercraft as in claim 6, wherein the footwell top width near the bend is not less than 13 inches.

* * * * *